US005676480A

United States Patent [19]

Tosto

[11] Patent Number: 5,676,480

[45] Date of Patent: Oct. 14, 1997

[54] HAIR DYE APPLICATING APPARATUS

[76] Inventor: Nada Tosto, 14 Carol La., Mastic Beach, N.Y. 11951

[21] Appl. No.: 630,944

[22] Filed: Apr. 5, 1996

[51] Int. Cl.[6] ..... A45D 24/22; A46B 11/00

[52] U.S. Cl. ..... 401/10; 132/108; 132/112; 401/35; 401/192; 401/199

[58] Field of Search ..... 401/199, 35, 9, 401/10, 192; 132/108, 112

[56] References Cited

U.S. PATENT DOCUMENTS

| | | | |
|---|---|---|---|
| 2,055,314 | 9/1936 | Seburger | 401/10 |
| 2,453,201 | 11/1948 | Cushman | 410/199 X |
| 2,458,027 | 1/1949 | Quist | 401/199 X |
| 3,056,998 | 10/1962 | Ebner | 401/10 X |
| 3,922,100 | 11/1975 | Saito | 401/199 |
| 5,154,193 | 10/1992 | Busch et al. | 132/108 X |
| 5,368,405 | 11/1994 | Sixiong | 401/199 |

FOREIGN PATENT DOCUMENTS

| | | | |
|---|---|---|---|
| 2715359 | 10/1978 | Germany | 401/199 |
| 3504262 | 8/1986 | Germany | 401/35 |
| 2248549 | 4/1992 | United Kingdom | 132/112 |

*Primary Examiner*—Steven A. Bratlie

[57] ABSTRACT

A hair dye applicating apparatus including a handle portion having a hollow interior adapted to hold hair dye therein. The device includes an applicating portion having a pair of applicator members. The applicator members have a coextensive main body portion extending inwardly of the handle portion. The device includes a cap member having an open end portion adapted for engagement to the handle portion disposed over the applicating portion.

1 Claim, 2 Drawing Sheets

HAIR DYE APPLICATING APPARATUS

BACKGROUND OF THE INVENTION

1. Field of the Invention

The present invention relates to a hair dye applicating apparatus and more particularly pertains to applying hair dye to strands or small groups of hair.

2. Description of the Prior Art

The use of applicators for dye is known in the prior art. More specifically, applicators for dye heretofore devised and utilized for the purpose of dying hair are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,154,193 to Busch et al. discloses a continuous hair dye dispensing device.

U.S. Pat. No. 5,343,880 to McKay discloses a fluid dispensing wand.

U.S. Pat. No. Des. 332,700 to Hill discloses the ornamental design for a combined comb and applicator for hair dye.

U.S. Pat. No. 5,152,305 to Niv discloses an applicator device.

U.S. Pat. No. Des. 266,357 to Kahn discloses the ornamental design for a combined container and applicator for hair dye.

U.S. Pat. No. 5,325,878 to McKay discloses a fluid dispensing comb.

While these devices fulfill their respective, particular objective and requirements, the aforementioned patents do not describe a hair dye applicating apparatus for applying hair dye to strands or small groups of hair.

In this respect, the hair dye applicating apparatus according to the present invention substantially departs from the conventional concepts and designs of the prior art, and in doing so provides an apparatus primarily developed for the purpose of applying hair dye to strands or small groups of hair.

Therefore, it can be appreciated that there exists a continuing need for a new and improved hair dye applicating apparatus which can be used for applying hair dye to strands or small groups of hair. In this regard, the present invention substantially fulfills this need.

SUMMARY OF THE INVENTION

In the view of the foregoing disadvantages inherent in the known types of applicators for dye now present in the prior art, the present invention provides an improved hair dye applicating apparatus. As such, the general purpose of the present invention, which will be described subsequently in greater detail, is to provide a new and improved hair dye applicating apparatus and method which has all the advantages of the prior art and none of the disadvantages.

To attain this, the present invention essentially comprises a handle portion that is generally elongated. The handle portion has an open first end, a closed second end, and a hollow interior. The open first end is internally threaded. The handle portion has an elongated window therein inwardly of the open first end thereof. The hollow interior is adapted to hold hair dye therein. The device includes an applicating portion comprised of a housing member having a first end and an open second end. The open second end is externally threaded for coupling with the internally threaded open first end of the handle portion. The applicating portion has a pair of applicator members having a main body portion extending inwardly of the first end of the housing member. The applicator members extend linearly from the first end of the housing member. The applicator members are spaced apart sufficiently to receive a small grouping of hairs therebetween. The device includes a cap member having an open end portion adapted for engagement to the handle portion disposed over the applicating portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hair dye applicating apparatus which has all the advantages of the prior art applicators for dye and none of the disadvantages.

It is another object of the present invention to provide a new and improved hair dye applicating apparatus which may be easily and efficiently manufactured and marketed.

It is a further object of the present invention to provide a new and improved hair dye applicating apparatus which is of durable and reliable construction.

An even further object of the present invention is to provide a new and improved hair dye applicating apparatus which is susceptible of a low cost of manufacture with regard to both materials and labor, and which accordingly is then susceptible of low prices of sale to the consuming public, thereby making such a hair dye applicating apparatus economically available to the buying public.

Still yet another object of the present invention is to provide a new and improved hair dye applicating apparatus which provides in the apparatuses and methods of the prior art some of the advantages thereof, while simultaneously overcoming some of the disadvantages normally associated therewith.

Even still another object of the present invention is to provide a new and improved hair dye applicating apparatus for applying hair dye to strands or small groups of hair.

Lastly, it is an object of the present invention to provide a new and improved hair dye applicating apparatus including a handle portion having a hollow interior adapted to hold hair dye therein. The device includes an applicating portion having a pair of applicator members. The applicator members have a coextensive main body portion extending inwardly of the handle portion. The device includes a cap member having an open end portion adapted for engagement to the handle portion disposed over the applicating portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
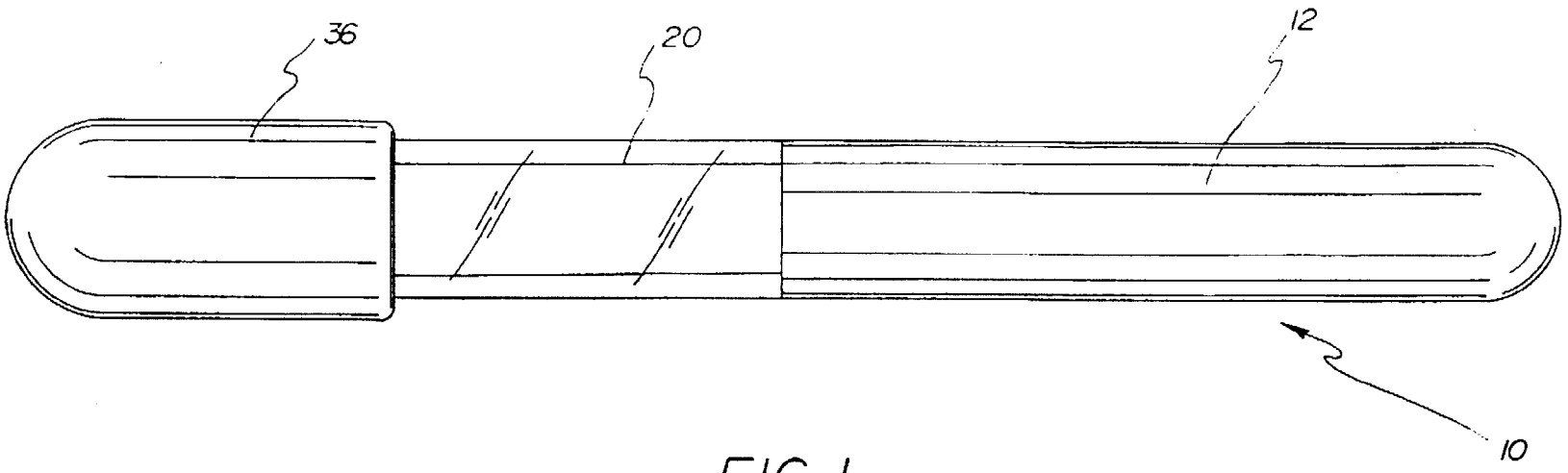
FIG. 1 is a perspective view of the preferred embodiment of the hair dye applicating apparatus constructed in accordance with the principles of the present invention.
Figure 2:
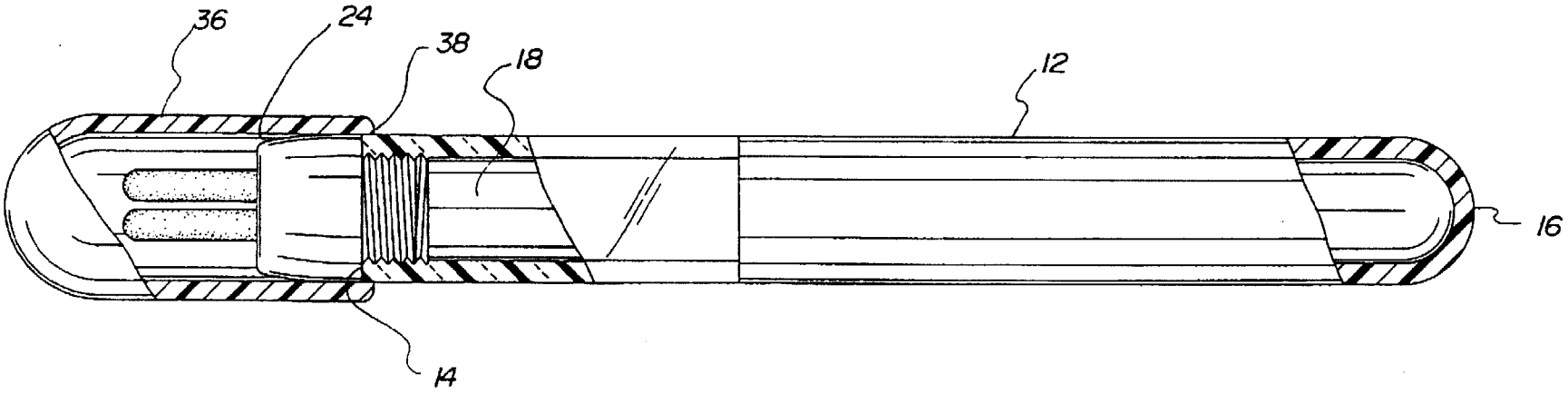
FIG. 2 is a side elevation view of the present invention shown in cross-section.
Figure 3:
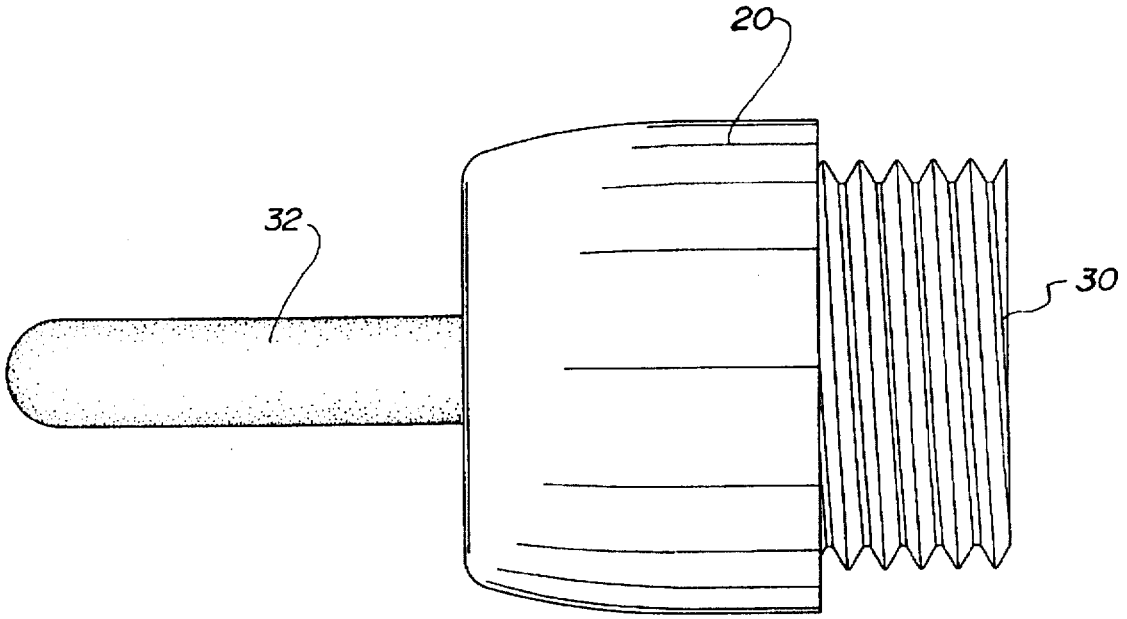
FIG. 3 is a side elevation view of the applicator members of the present invention.
Figure 4:
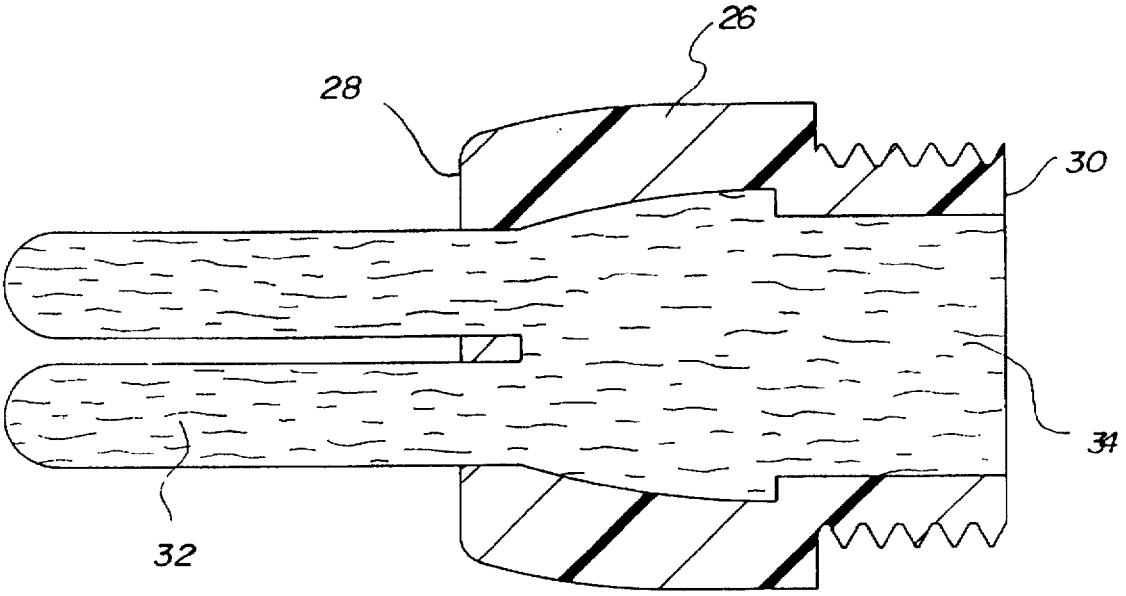
FIG. 4 is a side elevation view of the applicator members of the present invention shown in cross-section.

With reference now to the drawings, and in particular, to FIGS. 1–4 thereof, the preferred embodiment of the new and improved hair dye applicating apparatus embodying the principles and concepts of the present invention and generally designated by the reference number 10 will be described.

Specifically, it will be noted in the various Figures that the device relates to a new and improved hair dye applicating apparatus for applying hair dye to strands or small groups of hair. In its broadest context, the device consists of a handle portion, an applicating portion, and a cap member. Such components are individually configured and correlated with respect to each other so as to attain the desired objective.

The device 10 includes a handle portion 12 that is generally elongated. The handle portion 12 resembles a cylinder of an ink pen. The handle portion 12 has an open first end 14, a closed second end 16, and a hollow interior 18. The open first end 14 is internally threaded. The handle portion 12 has an elongated window 20 therein inwardly of the open first end 14 thereof. The hollow interior 18 is adapted to hold hair dye therein. The elongated window 20 allows for a user to notice a low level of hair dye therein. The open first end 14 allows for the hair dye to be added to the handle portion 12. The preferable construction of the handle portion 12 is of plastic or light weight metal.

The device 10 includes an applicating portion 24 comprised of a housing member 26 having a first end 28 and an open second end 30. The housing member is fabricated of semirigid materials. The open second end 30 is externally threaded for coupling with the internally threaded open first end 14 of the handle portion 12. The applicating portion 24 has a pair of semirigid applicator members 32 having a main body portion 34 extending inwardly of the first end 28 of the housing member 26. The pair of applicator members 32 extend linearly from the first end 28 of the housing member 26. The applicator members 32 are spaced apart sufficiently to receive a small grouping of hairs therebetween. Additionally, the pair of applicator members can be utilized as a tweezer to grasp individual strands or small groups of hairs. This is accomplished by squeezing the first end of the housing member thereby bending the applicator members toward each other to make contact. Squeezing the housing member prevents users from getting dye on their fingers during use. The applicator members 32 allow for a user to dye one or a small amount of hairs that have turned gray. Such a device 10 could be mostly utilized by people that have recently started to have their hair gray and do not require dying their entire head of hair. The device 10 will eliminate an alternative method of plucking gray hairs out of their head. The applicator members 32 are preferably fabricated of sponge or felt. Alternatively, a disposable version of the device 10 could be produced that has the applicating portion permanently secured to the handle portion 12. Once the device 10 is empty of dye, the device 10 could be thrown away.

Lastly, the device 10 includes a cap member 36 having an open end portion 38 adapted for engagement to the handle portion 12 disposed over the applicating portion 24. The cap member 36 protects the applicating members 32 as well as preventing the dye from drying within the members 32.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A hair dye applicating apparatus for applying hair dye to strands or small groups of hair comprising, in combination:

a handle portion being generally elongated, the handle portion having an open first end, a closed second end, and a hollow interior, the open first end being internally threaded, the handle portion having an elongated window therein inwardly of the open first end thereof, the hollow interior adapted to hold hair dye therein, the elongated window allowing users to notice hair dye levels within the hollow interior of the handle portion;

an applicating portion comprised of a semirigid housing member having a first end and an open second end, the open second end being externally threaded for coupling with the internally threaded open first end of the handle portion, the applicating portion having a pair of semirigid applicator members fabricated of sponge material, the applicator members having a coextensive main body portion extending inwardly of the first end of the housing member, the applicator members extending linearly from the first end of the housing member, the applicator members being spaced apart sufficiently to receive a small grouping of hairs therebetween, the applicator members being utilizable as tweezers by a user; and a cap member having an open end portion adapted for engagement to the handle portion disposed over the applicating portion.

* * * * *